US009969538B1

(12) United States Patent
Carr

(10) Patent No.: US 9,969,538 B1
(45) Date of Patent: May 15, 2018

(54) FLOW REDUCTION ATTACHMENT FOR STORAGE VESSEL

(71) Applicant: David John Carr, West Haven, CT (US)

(72) Inventor: David John Carr, West Haven, CT (US)

(73) Assignee: David J. Carr, West Haven, CT (US)

( * ) Notice: Subject to any disclaimer, the term of this patent is extended or adjusted under 35 U.S.C. 154(b) by 267 days.

(21) Appl. No.: 13/869,501

(22) Filed: Apr. 24, 2013

(51) Int. Cl.
*B65D 47/06* (2006.01)
*B65D 47/12* (2006.01)

(52) U.S. Cl.
CPC ..... *B65D 47/06* (2013.01); *B65D 47/12* (2013.01)

(58) Field of Classification Search
CPC ..... B65D 47/06; B65D 47/12; B65D 47/122; B65D 47/123; B65D 47/127; B65D 47/128; B65D 47/32; B65D 47/043; B65D 25/38
See application file for complete search history.

(56) References Cited

U.S. PATENT DOCUMENTS 2,848,145 A * 8/1958 Livingstone ..... B65D 47/40 215/392
3,942,660 A * 3/1976 Paller ..... B65D 1/023 215/386
4,187,964 A * 2/1980 Bogart ..... B65D 47/123 222/546
4,396,134 A * 8/1983 Owens ..... B65D 47/40 222/562
4,475,274 A * 10/1984 Beckstrom ..... B65D 47/123 215/392
4,494,682 A * 1/1985 Beckstrom ..... B65D 47/123 222/551
4,530,447 A * 7/1985 Greenspan ..... B65D 83/04 221/288
5,100,009 A * 3/1992 Thompson ..... B21D 51/30 215/341
5,195,662 A * 3/1993 Neff ..... B44D 3/128 220/700
5,388,731 A * 2/1995 Mengeu ..... B29C 45/4407 215/277
5,568,879 A * 10/1996 Kovathana ..... B44D 3/128 220/697
5,752,619 A * 5/1998 Fulton ..... B44D 3/128 220/701
D415,959 S * 11/1999 Antoine ..... D9/724
(Continued)

FOREIGN PATENT DOCUMENTS

JP 2013047116 A * 3/2013 ..... B65D 47/043

*Primary Examiner* — Christopher R Harmon

(57) ABSTRACT

This is a new and useful improvement to liquid and dry product containers, modifying the flow rate of delivery. The user sandwiches the invention between the cap and existing vessel, which reduces the delivery rate of the product from the container when poured by the user. The invention conserves product quantity and reduces loss in an accidental spill. The invention is designed to fit a variety of containers. The invention is designed to dispense different products at desired flow rates. The invention is designed to be modified for specific applications. The invention can be reused after the vessel is emptied, thus conserving production material. The improvement is obvious because it benefits the consumer, not the manufacturers.

4 Claims, 6 Drawing Sheets

(56) References Cited

U.S. PATENT DOCUMENTS

Figure 1:
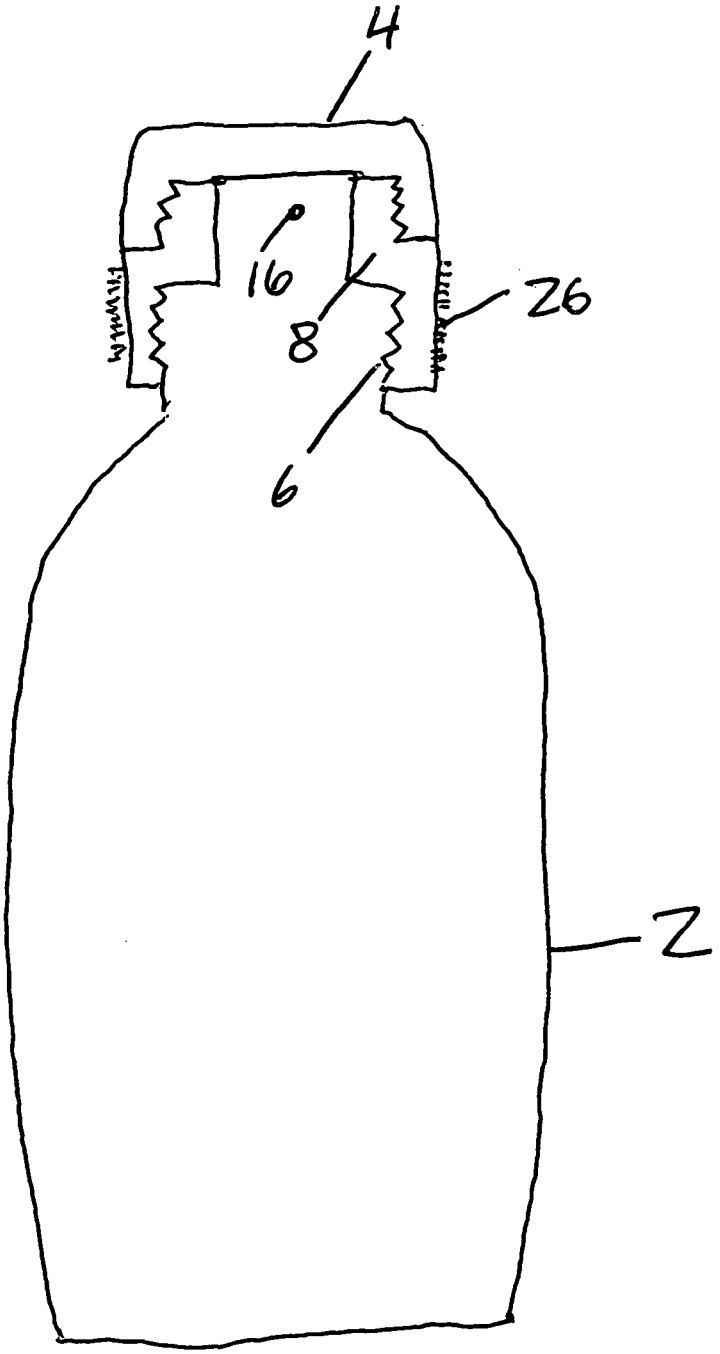

| | | | | |
|---|---|---|---|---|
| 6,041,982 | A * | 3/2000 | Cautereels | B65D 25/48 215/307 |
| 6,244,433 | B1 * | 6/2001 | Vieu | B65D 81/3211 206/221 |
| 6,450,368 | B1 * | 9/2002 | De LaForcade | B65D 1/04 206/221 |
| 7,066,323 | B1 * | 6/2006 | Reisman | B01F 15/0205 206/222 |
| 8,763,829 | B2 * | 7/2014 | Madaus | 215/44 |
| 2004/0026450 | A1 * | 2/2004 | Rohr | B44D 3/12 222/109 |
| 2004/0245204 | A1 * | 12/2004 | Suffa | B65D 41/0471 215/224 |
| 2005/0269376 | A1 * | 12/2005 | Hsieh | B65D 47/128 222/562 |
| 2006/0180585 | A1 * | 8/2006 | Cunningham et al. | 220/203.06 |
| 2006/0243744 | A1 * | 11/2006 | Kessell et al. | 222/147 |
| 2007/0114251 | A1 * | 5/2007 | Yue | 222/500 |
| 2007/0119727 | A1 * | 5/2007 | Cho | B65D 51/2892 206/219 |
| 2008/0289976 | A1 * | 11/2008 | Henry | B65D 81/3211 206/222 |
| 2011/0278206 | A1 * | 11/2011 | Hull et al. | 210/85 |
| 2011/0303670 | A1 * | 12/2011 | Baker | A61J 1/1412 220/257.1 |
| 2012/0152884 | A1 * | 6/2012 | Lee | B65D 47/043 215/258 |
| 2012/0260487 | A1 * | 10/2012 | Nichols | 29/456 |
| 2013/0233898 | A1 * | 9/2013 | Resnikoff et al. | 222/568 |

* cited by examiner

FLOW REDUCTION ATTACHMENT FOR STORAGE VESSEL

CROSS REFERENCE TO RELATED APPLICATIONS

61/686,947

SEQUENCE LISTING OR PROGRAM

None

BACKGROUND

Field of Invention

This invention relates to a detachable, reusable pouring fitment for containers, temporarily installed by the manufacturer or the end user, specifically an improved mechanism for reducing the flow of product by the end user.

Discussion of Prior USPTO Art and Obviousness of Invention

Containers are not always designed to conserve the contents when the container is tipped, or provide protection from accidental spillage. Some containers have an opening that allows over pouring or spilling due to the viscosity of the product. Previous and current art seems to consistently employ either a cap that fits the container with the orifice reducer inserted, or the orifice reducer being part of the whole cap and closure. I have not found any means to modify an existing vessel and mated original cap that can be installed by the end user. Flow reduction, when provided in original packaging, is often inserted for one time use and disposal, like U.S. Pat. No. 4,427,138, FIG. 2 or U.S. Pat. No. 7,097,076. U.S. Pat. No. 7,237,692 achieves my intended result without a closure function. In U.S. Pat. No. 7,870,980.B2 we see Part 108 and Part 110 creating the smaller deliver orifice to conserve product. U.S. Pat. No. 6,209,762 controls flow velocity (FIG. 5) but is not removable or reusable. U.S. Pat. No. 4,736,874 is similar to mine without original cap interface. U.S. Pat. No. 4,433,800 lacks mating ability to remove after use My invention will allow the end user to achieve unavailable flow reduction and product conservation. My invention can be manufactured from appropriate, durable materials. My invention can be washed, reused on another vessel of similar closure style, or transferred to new container as soon as needed the contents are depleted. My invention will conserve resources by reducing waste.

HISTORY OF THE INVENTION

I manufactured the first working prototype on Feb. 22, 2011, which I have photographed and traced in the attached drawings. I requested a PTO customer number (000015388) on May 20, 2011, and submitted a provisional patent on Apr. 16, 2012.

OBJECTS AND ADVANTAGES

Several Objects and advantages of my invention are:

a) Provides a means for user to pour contents at a slower rate of flow from the original container when container is tilted from upright position.

b) When installed by user, invention is sandwiched/nested between original container opening and original container cap until container is emptied.

c) Can be manufactured to fit the original size of any pre-existing container and lid to mate (by twisting, snapping or pressing) to original container threads, ridges tongue or groove.

d) Can be manufactured to fit the original size of the pre-existing cap of container with appropriate male threads or ridges to mate to original container cap threads or ridges.

e) May have optional ridges or textured surface on exterior circumference to allow easy pivotal installation and removal by user.

f) May have optional raised lip around smaller orifice at top to create a better seal contact with pre-existing cap.

g) May have optional raised lip around smaller orifice at top to facilitate easier pouring of material by user.

h) May be pivotally attached to be sandwiched/nested between container opening and cap depending on design of cap and container.

i) May be installed by being snapped onto a lip of the original to be sandwiched/nested between container opening and cap.

j) May be pressed in a groove on the top of the container (like a paint can) to be sandwiched/nested between container opening and lid.

k) Provides an orifice of any required shape that is smaller than the opening of original container.

l) May have multiple orifices of different sizes and shapes to allow air intake while dispensing product depending on end users specification m) May be round, oval, square or any size necessary to fit between original container cap and neck of original container.

n) May be fabricated metal or glass, or injection-molded plastic, rubber or any new or recycled rigid material appropriate for interacting with the ingredient to be dispensed from the original container.

o) The invention creates a temporarily smaller delivery orifice in the original container whereby providing user a means to reduce the velocity of product disbursement from the original container while using the original cap and/or closure system.

BRIEF SUMMARY OF THE INVENTION

My invention achieves its intended result by reducing the size and/or shape of the original container aperture while using the original cap to close the original container. The reduction of the delivery aperture diameter will reduce the flow velocity and delivery rate while conserving quantity of product. My invention will prevent excessive loss in case of over pouring or spilling. A second, optional orifice may be added to facilitate airflow, creating a even disbursement of product. A funnel design is one of my claims, may be incorporated to improve delivery of certain products. My invention may be removed and reused on another original container with the same design specification.

BRIEF DESCRIPTION OF DRAWINGS AND REFERENCE NUMERALS

My invention has no moving parts. The Flow Reduction Attachment improves the original container and lid by sandwiching.

2) Original Container Wall

4) Original Container Cap

6) Interior Mating Thread of Invention
8) Exterior Mating Thread of Invention
10) Interior Mating Lip (or Ridge) of Invention
12) Exterior Mating Lip (or Ridge) of Invention
14) Top view of the invention
16) Flow reduction orifice aperture
18) Ridges or textured surface on exterior wall for gripping
20) Aperture support/flow restriction wall
22) Mating tongue for paint can style
24) Mating groove for paint can style
26) Body of invention (shaded)
28) Finger tab
30) Raised lip

OBJECTS AND ADVANTAGES a) Allows the user to temporarily reduce the size and/or shape of the opening of the original, preexisting container.
b) Reduces the volume and velocity of flow at time of use.
c) Facilitates conservation of material and loss reduction in the event of spillage. The smaller delivery aperture increases the time required to dispense the same amount of product depending on the users' choice of aperture size and/or shape.
d) Allows consumer to pour juice, milk, medicine, liquid concentrate, food ingredients, and otter valuable liquids or powders without accidental over pouring if the bottle is tipped too far.
e) Allows a precious liquid to be dispensed very slowly if it was sold in a container with a large orifice.
f) Allows the end user to temporarily change the size of the original container opening without changing the entire container or cap since the invention is sandwiched between the top of the container and the original cap or lid using the existing closure system.

DETAILED DESCRIPTION—FIG. 1 PREFERRED EMBODIMENT

FIG. 1 Shows the flow reduction attachment sandwiched between on an original container (2) and the original cap (4). The interior (6) and exterior (8) threads match the thread design of the host container. The delivery aperture (16) is smaller than the mouth of the original container. The optional textured ridges or bumps (18) allow easy gripping by user. The installed invention will reduce the flow rate from the vessel.

Figure 2:
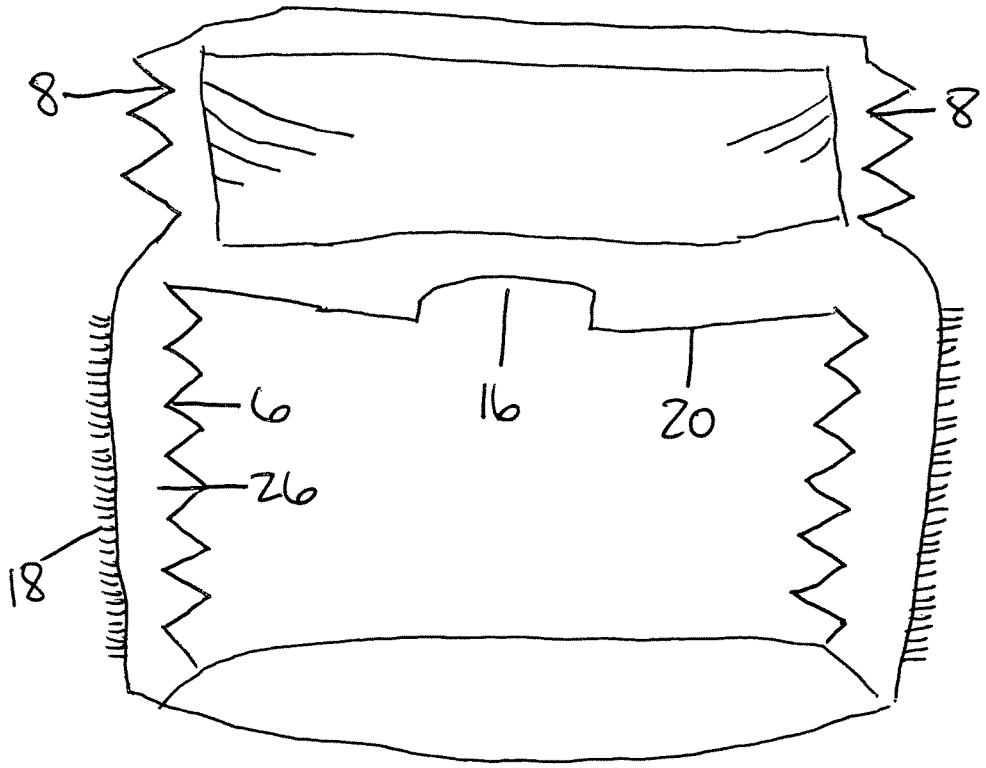

FIG. 2 shows the flow reduction attachment with exterior (8) and interior (6) threads for mounting on the original cap and bottle. Flow reduction orifice (16) aperture is supported by the flow restriction wall (20). Textured ridges (18) on the exterior wall for pivotal gripping.

Figure 3:
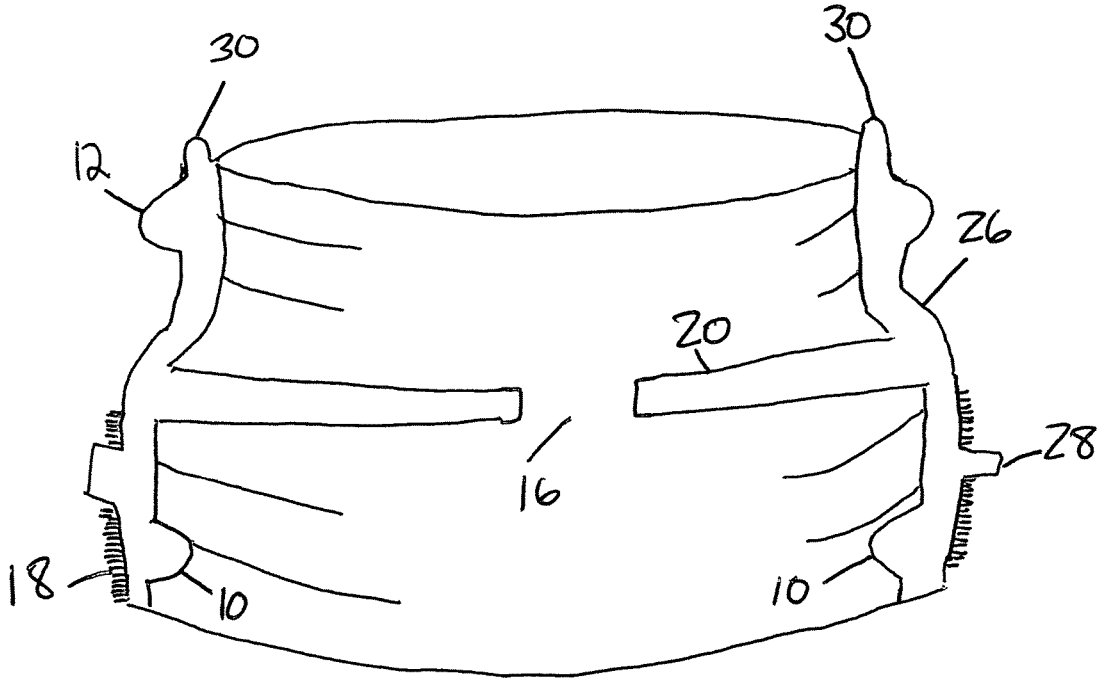
Figure 4:
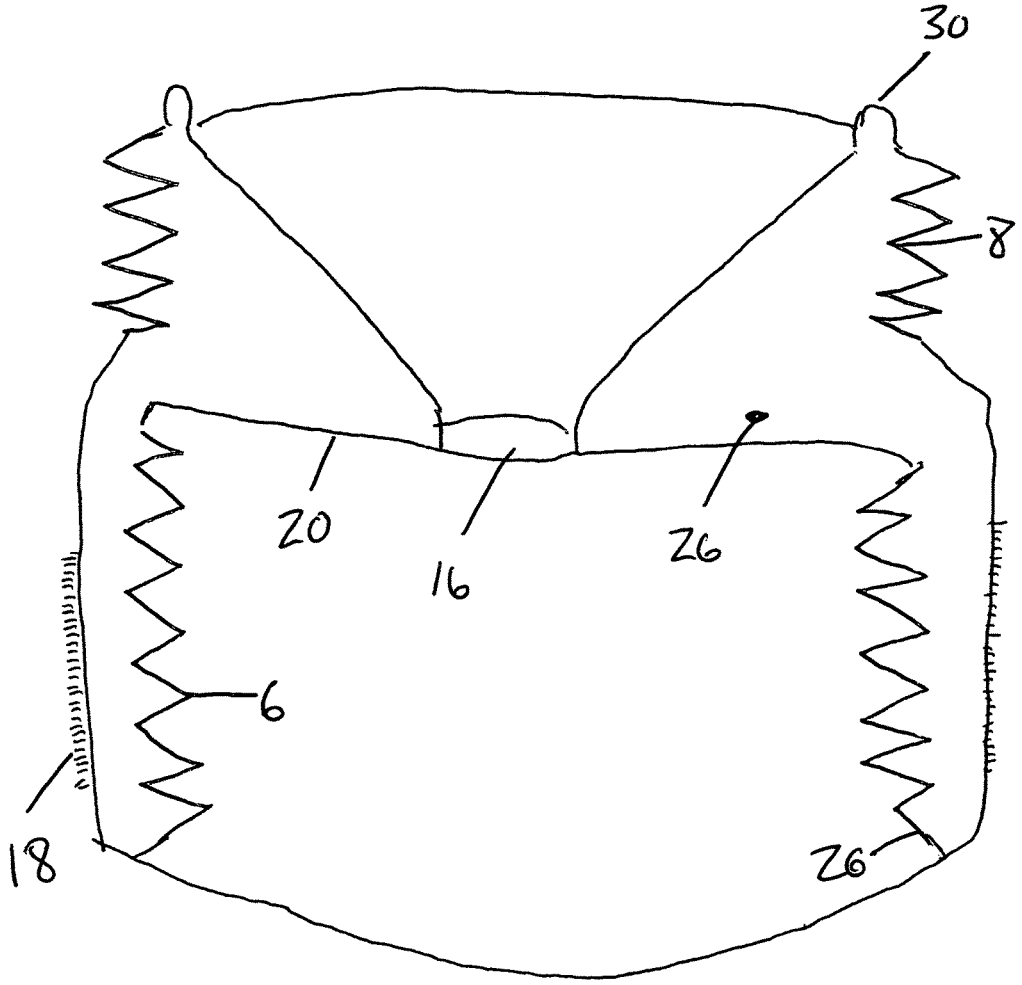

FIG. 3 Design for flow reduction attachment used with a original container with a snap style lid. The aperture support/flow restriction wall (20) is in the middle of the invention with the flow reduction orifice (16) in the center of the restriction wall (20). Tabs (28) are shown to ease installation and removal of the invention. Exterior (12) and interior (10) ridges for interlock with the snap on host container. The distance of the external ridge (12) and internal ridge (10) from the top or bottom of the invention body (26) will vary with container and lid design FIG. 4 Flow reduction attachment exhibiting interior (6) and exterior (8) threads. The flow reduction orifice (16) is in the center of the restriction wall (20). FIG. 3 shows a modified design of a flow reduction orifice (16) incorporating a funnel to assist pouring from the host container after the flow has been reduced. The raised lip (30) on top of the attachment aids pouring and closure of original cap. This design increases the mass of the invention body (26).

Figure 5:
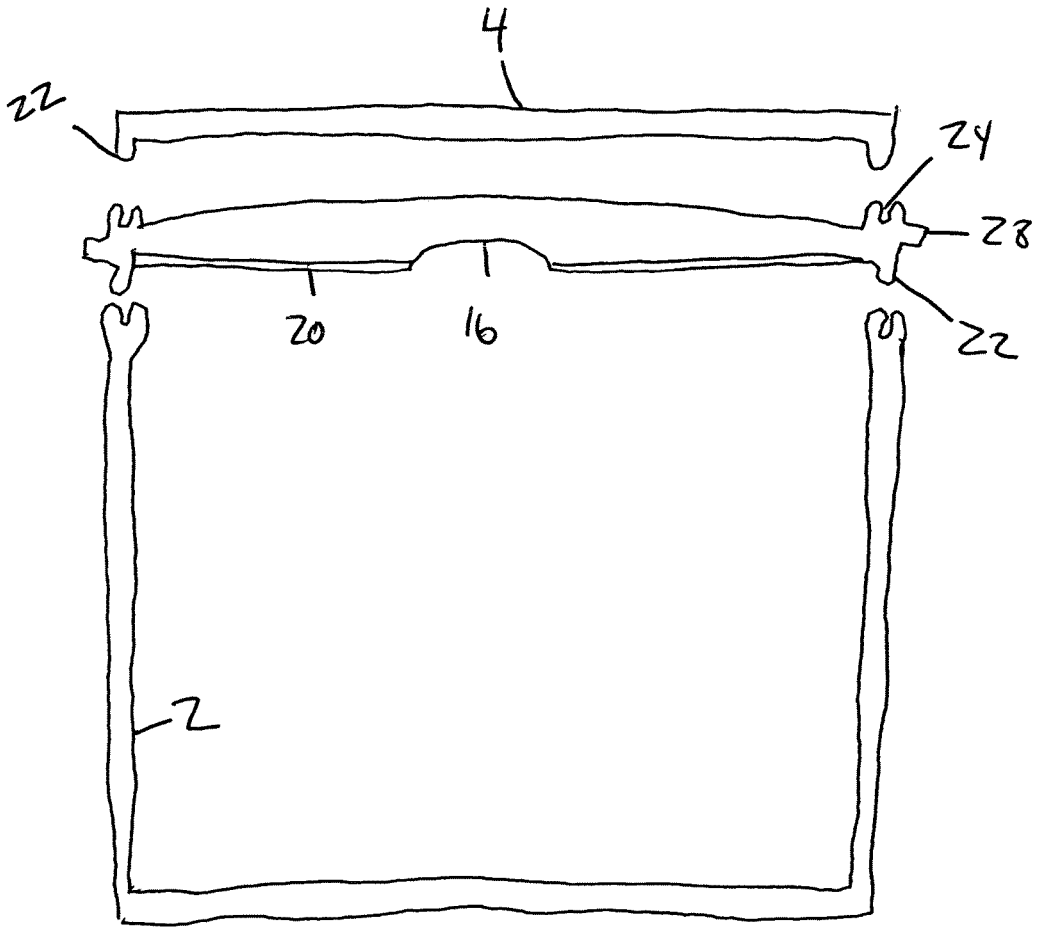
Figure 6:
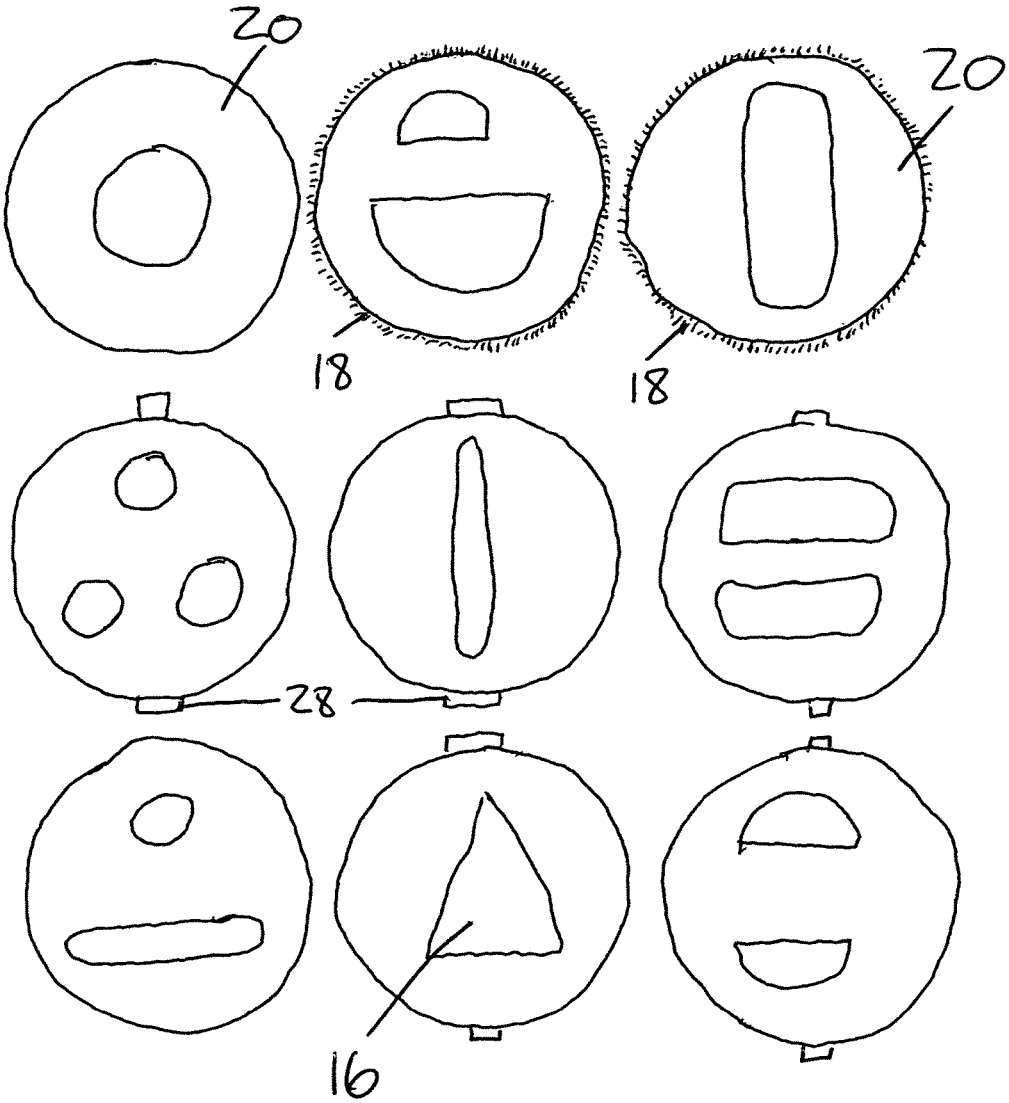

FIG. 5 Shows a tongue (22) and mating groove (24) for paint can style lid (4) with invention sandwiched between original lid and container. A flow reduction orifice (16) in the center of the restriction wall conserves material when poured (20). Tabs (28) are shown to ease installation and removal of the invention, FIG. 6 Alternative Embodiments Top view (14) looking down of the flow reduction attachment with a variety of flow reduction orifice (16) designs to create different flow rates with different materials. Multiple orifices (16) allow for air flow creating a smooth transfer of material. Textured ridges are on the exterior wall for gripping (18). Orifices are (16) seen on flow restriction wall (20) shown. Tabs (26) are shown to ease installation and removal of the invention from a container using a ridge lip or tongue and groove closure. Threads, grooves and ridges for sandwiching invention between vessel and lid are omitted here, as the objective in FIG. 5 is to show the orifice design only

POTENTIAL SCOPE AND SPECIALIZATION OF THE INVENTION

The invention has a broad range of applications including:
a) Salad dressings and syrup
b) Paint cans,
c) Powdered concentrate,
d) Liquid concentrates,
c) Toothpaste consistency products in squeeze tubes
f) Gallon bulk bottles of food ingredients
g) Medicine
h) Personal fragrances,
i) Motor oils and motor additives
j) Beverages ready to drink
k) 55 gallon drums and 5 gallon buckets

SUMMATION

My invention can improve the efficiency of any size container that is tipped to allow delivery of the product by gravity. Upper exterior diameter threads, grooves, ridges or lips of the invention mate with the original snap, press screw cap closure design. Lower Interior Diameter threads, ridges or lips of the invention match the exterior diameter threads, ridges or lips of the original container. The invention will be pivotally installed between an original lid and original container with threads, forming an air or watertight seal employing the same mating specifications the container manufacturer chose. A paint can version will be sandwiched between the cover and container with matching male and female grooves. A smaller aperture configuration will reduce the flow of material, conserving the product and preventing excess loss in case of spillage. The snap on version employs interior and exterior ridges to join with a lip style closure system. The invention may be stored on the container while depleting the product, then reinstalled on a replacement container. The invention will allow the user to conserve materials of different consistencies by reducing the delivery rate. The invention will reduce loss in an accidental spill. The invention has no moving parts.

The invention claimed is:

1. A cylindrical fitment comprising a flow reduction member between open top and bottom portions; wherein the inner surface of said open bottom portion has coupling elements configured for coupling to corresponding exterior coupling elements of a container with a corresponding closure removed; the exterior surface of said open top portion has coupling elements configured for coupling to corresponding interior elements of the removed container closure; and said flow reduction member comprises at least one orifice smaller than the fitment inner diameter for reducing the flow of a product from within said container when said fitment is coupled to said container.

2. The cylindrical fitment of claim 1, wherein said bottom portion and top portion coupling elements are rotational threads.

3. The cylindrical fitment of claim 1, wherein said bottom portion and top portion coupling elements are snap fit ridges.

4. A cylindrical fitment comprising a flow reduction member between open top and bottom portions; wherein the surface of said open bottom portion has a coupling tongue configured for coupling to a corresponding exterior coupling groove of a container with a corresponding closure removed; the exterior surface of said open top portion has a coupling groove configured for coupling to a corresponding coupling tongue of the removed container closure; and said flow reduction member comprises at least one orifice smaller than the fitment inner diameter for reducing the flow of a product from within said container when said fitment is coupled to said container.

* * * * *